US005077853A

United States Patent [19]

Campbell

[11] Patent Number: 5,077,853

[45] Date of Patent: Jan. 7, 1992

[54] POOL CLEANER

[76] Inventor: Sanford F. Campbell, 1850 Crestmont Dr., Redding, Calif. 96002

[21] Appl. No.: 639,905

[22] Filed: Jan. 10, 1991

Related U.S. Application Data

[63] Continuation of Ser. No. 536,443, Jun. 11, 1990, abandoned.

[51] Int. Cl.[5] ..... E04H 3/20

[52] U.S. Cl. ..... 15/1.7

[58] Field of Search ..... 15/1.7, 319; 210/169; 114/222

[56] References Cited

U.S. PATENT DOCUMENTS

| | | | |
|---|---|---|---|
| 3,972,339 | 8/1976 | Henkin et al. | 15/1.7 |
| 4,023,581 | 5/1977 | Pansini et al. | 15/1.7 |
| 4,100,641 | 7/1978 | Pansini | 15/1.7 |
| 4,589,986 | 5/1986 | Greskovics | 15/1.7 |
| 4,768,532 | 9/1988 | Johnson | 15/1.7 X |

FOREIGN PATENT DOCUMENTS

| | | | |
|---|---|---|---|
| 0015365 | 2/1979 | Japan | 15/1.7 |

*Primary Examiner*—Edward L. Roberts
*Attorney, Agent, or Firm*—Leonard D. Schappert

[57] ABSTRACT

A pool cleaner is provided constructed of a body having freely moving wheels positioned thereon to contact the bottom surface of a pool, a large diverter wheel in front designed to contact the edge of a pool during operation, diverting the pool cleaner right or left, a water flow mechanism to hold the pool cleaner against the surface of a pool while picking up debris therefrom and a propulsion mechanism which utilizes water pressure to propel the pool cleaner forward and periodically backward to extricate it from tight quarters.

5 Claims, 3 Drawing Sheets

POOL CLEANER

This is a continuation of application Ser. No. 07/536,443, filed 6/11/90, now abandoned.

BACKGROUND OF THE INVENTION

1. Field of the Invention

The present invention relates generally to devices known as pool sweeps or pool cleaners, and more specifically to pool cleaners which include mechanisms to allow them to act robotically on the bottom of a pool, and which are designed to clean the bottom surface and edges of a pool, as well as picking up debris therefrom.

2. Description of the Prior Art

In the past, inventors have directed their efforts toward the construction of pool cleaners designed to collect leaves and other debris and generally to clean pools. Some such devices have included minimal robotics to determine the direction and speed at which the pool cleaner or pool sweep travels. Such pool sweeps or pool cleaners have generally relied on heavy gearing and traction to ensure their proper operation on the bottom surface of a pool. None of the prior art of which applicant is aware has taught a pool cleaner having the unique features of the present invention which allow it to operate without reliance on traction, and which also allow it to extricate itself from positions in which most pool cleaners get stuck and remain until someone comes to remove them.

SUMMARY OF THE INVENTION

The present invention consists of a pool cleaner constructed of a body having wheels positioned thereon to contact the bottom or side surfaces of a pool, and a large wheel in the front designed to contact edges of a pool to divert the path of the pool cleaner to keep it in operation. Further, the present invention includes propulsion means consisting of water outlets designed to propel the pool cleaner along the bottom of the pool without requiring the gearing normally required and without requiring power to the wheels. It further includes a water outlet designed to exert a downward pressure on the pool cleaner unit to keep the wheels in contact with a pool bottom or pool side to ensure smooth operation of the unit. A timing mechanism internal to the pool cleaner periodically diverts water to a set of outlets to create pressure in a reverse direction substantially opposite to that normally utilized to propel the pool cleaner, thereby extricating the pool cleaner from tight spots or positions in which it would normally be stuck for hours or until someone released it.

One of the objects of the present invention is to provide a pool cleaner which is lightweight, efficient and cost-effective.

Another object of the present invention is to provide a pool cleaner which does not depend on traction to ensure proper operation.

A further object of the present invention is to provide a pool cleaner which is propelled by water exiting an outlet in a given direction, thereby propelling the pool cleaner forward.

Another object of the present invention is to provide a pool cleaner having a mechanism designed to periodically reverse the flow of water so that the pool cleaner is propelled in a direction opposite to the normal direction of operation, thereby removing it from tight spots where it might otherwise get stuck.

A further object of the present invention is to provide a pool cleaner which utilizes a water outlet to create a downward pressure on the pool cleaner, thereby keeping it in contact with the bottom surface or side surface of a pool.

The foregoing objects, as well as other objects and benefits of the present invention, are made more apparent by the descriptions and claims which follow.

DESCRIPTION OF THE PREFERRED EMBODIMENT

Figure 1:
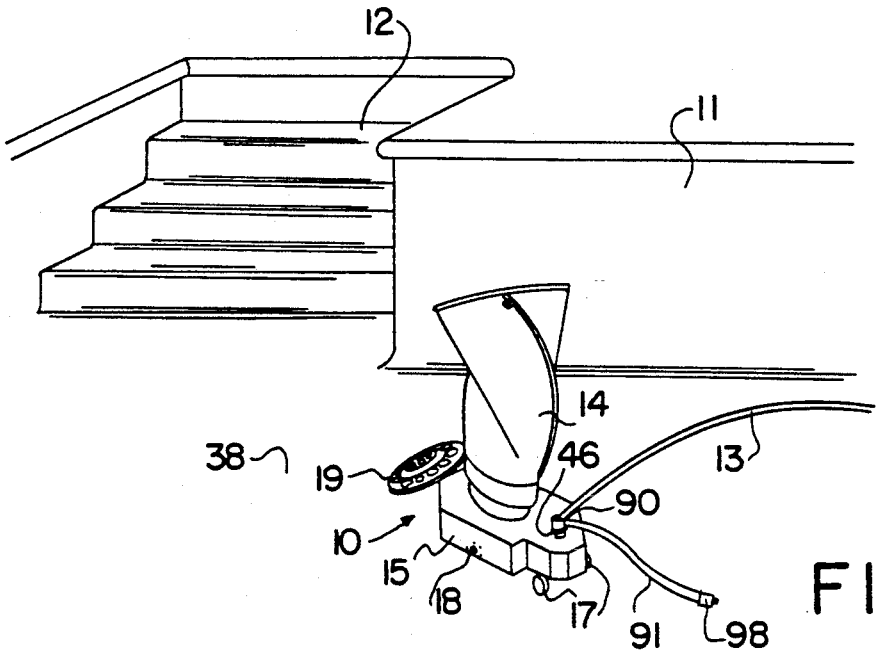
FIG. 1 is a perspective view showing the pool cleaner in position on the bottom surface of a pool floor.

FIG. 1 of the drawings is a perspective view showing the pool cleaner 10 of the present invention positioned on the floor 38 of a pool. The stairs 12 going into the pool are shown, as is pool wall 11. The pool cleaner 10 includes a body 15 which houses the mechanism that operates the pool cleaner 10. Pool cleaner 10 also includes wheels 17 and 18 which are attached to body 15 to facilitate movement of pool cleaner 10 across the floor 38 of a pool. A nipple 46 is provided to accept an adaptor 90 and water line 13 to route water to the pool cleaner 10 for use in collecting debris from the bottom surface of a pool, as well as for use in propelling the unit. Water is also routed through adaptor 90 to sweep hose 91, which may have a nozzle 98 at its end. Sweep hose 91 swings back and forth as a result of water exiting nozzle 98, cleaning the floor 38 of the pool in the process. A diverting wheel 19 is provided at the front of pool cleaner 10 to divert pool cleaner 10 to the left or right when it encounters the wall 11 of a pool. A pool cleaner bag 14 is provided to house refuse collected during the cleaning operation.

Figure 2:
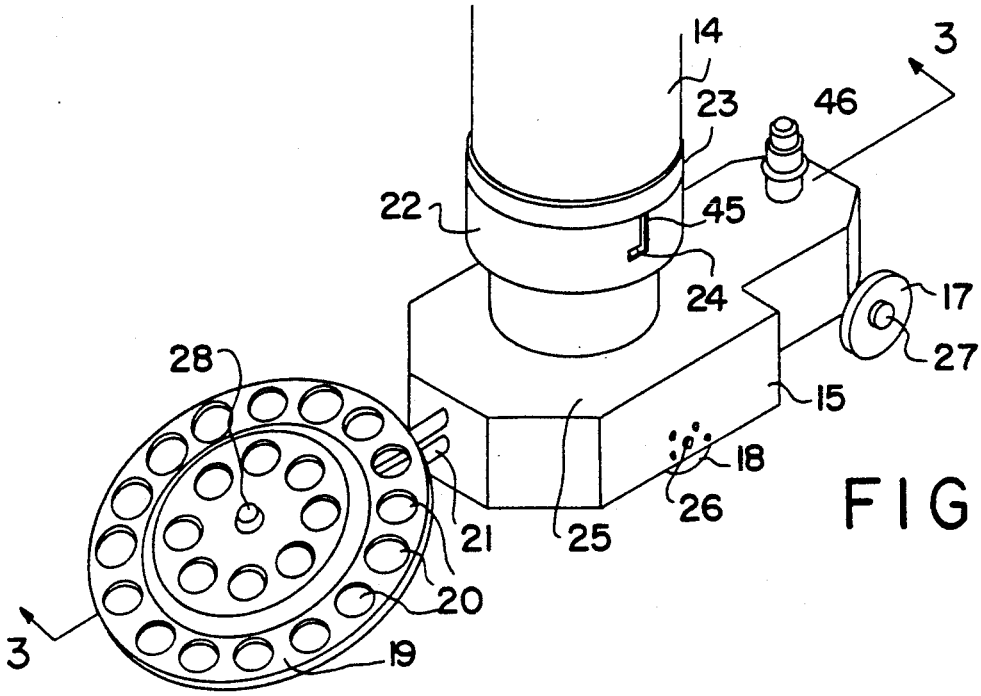
FIG. 2 is a perspective view of the pool cleaner of FIG. 1 more specifically showing the construction thereof.

FIG. 2 is a perspective view more clearly showing the structure utilized in constructing pool cleaner 10. Body 15 includes a top 25 to which fitting 22 is attached. A bag base 23 is provided to which a bag 14 attaches. Bag base 23 slides inside an opening of fitting 22, and further includes a pin 24 which slides into slot 45, thereby locking bag base 23 into position with respect to fitting 22. A nipple 46 is provided for attachment to a water line, thereby providing water for the operation of pool cleaner 10. Wheels 17 are rotatably mounted on axle 27, which is attached to body 15, and they rotate freely thereon. Wheels 18 are rotatably attached to body 15 by an axle 26, and they rotate freely thereon. The wheels associated with pool cleaner 10 rotate freely, and are not connected to any gearing devices in the present embodiment. A diverting wheel 19 is provided at the front end of pool cleaner 10 and is attached thereto by extension 21, which is rigidly attached to body 15 of pool cleaner 10, and which is attached to diverting wheel 19 by a screw 28 or other means which allow it to rotate freely with respect to extension 21. Diverter wheel 19 has holes 20 positioned therein. The purpose of holes 20 in diverter wheel 19 is to allow water to move freely therethrough and to decrease the weight of the pool cleaner 10, thereby increasing the mobility of pool cleaner 10.

Figure 3:
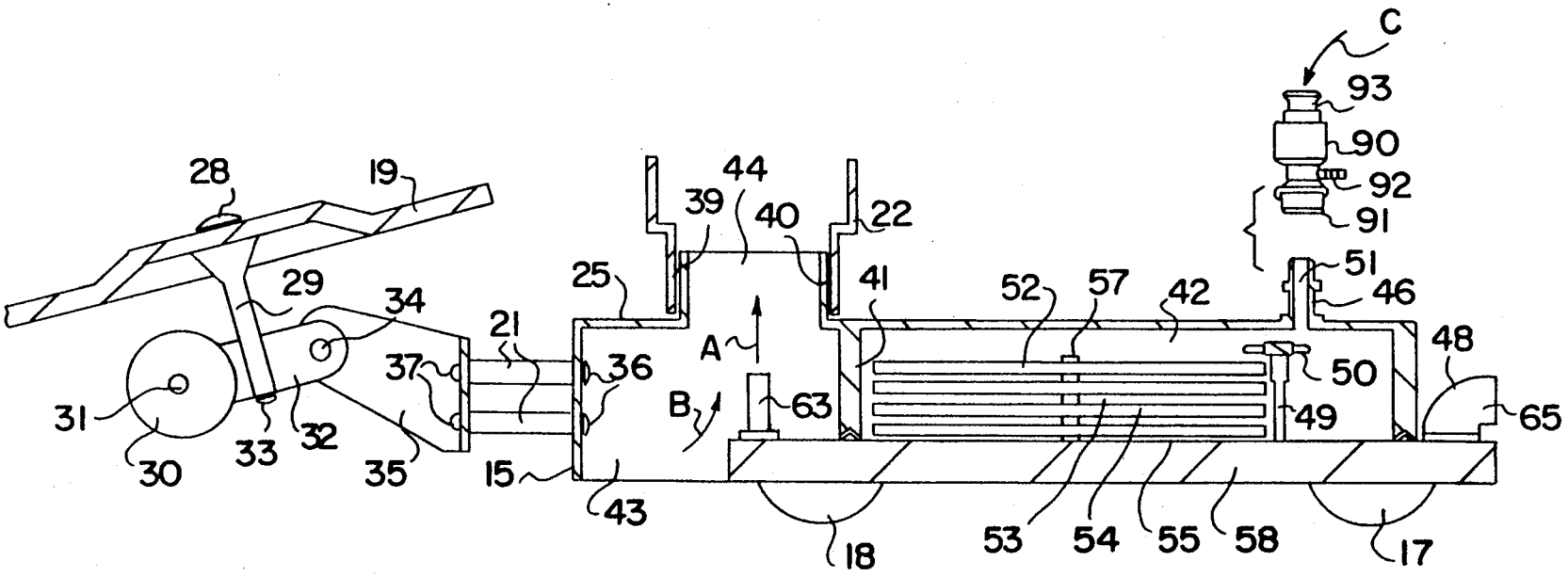
FIG. 3 is a cross-sectional view of the pool cleaner of FIG. 2 taken along lines 3—3 of FIG. 2 and showing a portion of the internal structure of the pool cleaner of FIG. 2.
Figure 4:
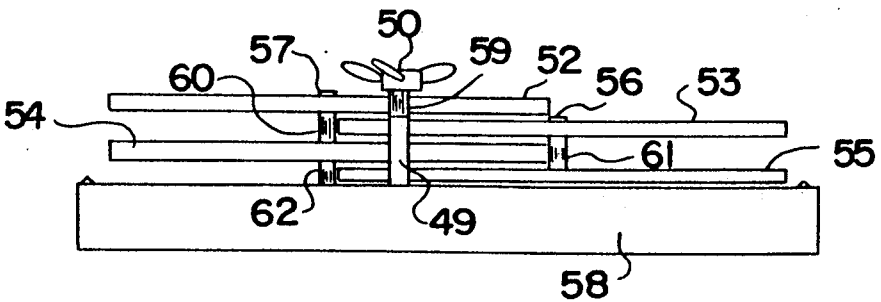
FIG. 4 is an expanded view showing the construction of a portion of the gearing unit utilized to periodically reverse the flow of water through the pool cleaner to change its direction taken along lines 4—4 of FIG. 5.

FIG. 3 is a cross-sectional view of pool cleaner 10 taken along lines 3—3 of FIG. 2. Extensions 21 are substantially rigidly attached to the wall of body 15 by means of screws 36 and nuts 37. Extensions 21 are further attached to bracket 35 by the same screw 36-and-nut 37 arrangement. A bracket 32 is pivotally attached to bracket 35 by a bolt 34, which allows it to pivot with respect thereto, thereby adjusting the angle of diverter wheel 19 with respect to the surface of a pool in which pool cleaner 10 is operating. An axle 29 is attached to bracket 32 by means of a screw 33, and diverter wheel 19 is attached thereto by means of a screw 28 or other attachment means which allows diverter wheel 19 to rotate freely thereon with respect to brackets 32 and 35. Wheel 30 is mounted at the front end of bracket 32 by means of axle 31, which allows wheel 30 to rotate freely with respect to bracket 32. The purpose of wheel 30 is to assist pool cleaner 10 in moving up a curved edge of a pool. When pool cleaner 10 reaches a given point at the edge of a pool, the edge of diverter wheel 19 will contact the side of the pool, and pool cleaner 10 will be diverted to the right or left, depending on its initial position. A cavity 43 is provided which is open to the pool at the bottom of body 15 of pool cleaner 10, and which includes an opening 44 through the top area of pool cleaner 10. A fitting 63 is provided through which water flows to assist in collecting debris from the pool. When water flows through fitting 63 through opening 44 of extension 40 and through fitting 22 into a pool sweep bag 14 as shown in FIGS. 1 and 2, the water flowing along arrow A creates a Venturi effect, thereby sucking water along arrow B from underneath the pool cleaner 10 which picks up debris from the bottom surface of the pool. A wall 41 is provided inside body 15 to isolate cavity 43 from cavity 42 inside pool cleaner 10. Cavity 42 is provided to facilitate control of the water flow through pool cleaner 10. Water from cavity 42 ultimately flows to fitting 63, but also flows through a group of passageways to fitting 48, as well as to other fittings to control the direction in which the pool cleaner 10 is propelled. This water flow will be dealt with more completely in the discussion of FIGS. 4 through 7 which follows. Adaptor 90 attaches at 93 to a pressurized water line and at 91 to nipple 46. Water flows along arrow C through adaptor 90 and into hole 51 of nipple 46. As water flowing through nipple 46 exits into cavity 42 of pool cleaner 10, it flows past a propeller 50, turning it. While a propeller 50 was utilized herein, any other pressure-sensitive device capable of turning as a result of water pressure would be equally usable. Propeller 50 is mounted on pin 49, which allows it to rotate with respect to body 15. A set of gears 52, 53, 54 and 55 are mounted on pins 56 and 57 as shown in FIG. 4, and they turn when propeller 50 is turned. Water also exits adaptor 90 through orifice 92 to a sweep hose, as previously discussed.

FIG. 4 of the drawings shows more specifically that propeller 50 includes a small gear 59 having teeth positioned thereon. Each of the gears 52, 53, 54, 55, 59, 60, 61 and 62 and propeller 50 are all mounted in position with respect to a base 58 so that they are held in contact with each other as shown. The structure of the mechanism utilized in routing the water through different passageways to control the direction of the pool cleaner 10 shown in FIG. 4 is taken along lines 4—4 of FIG. 5.

Figure 5:
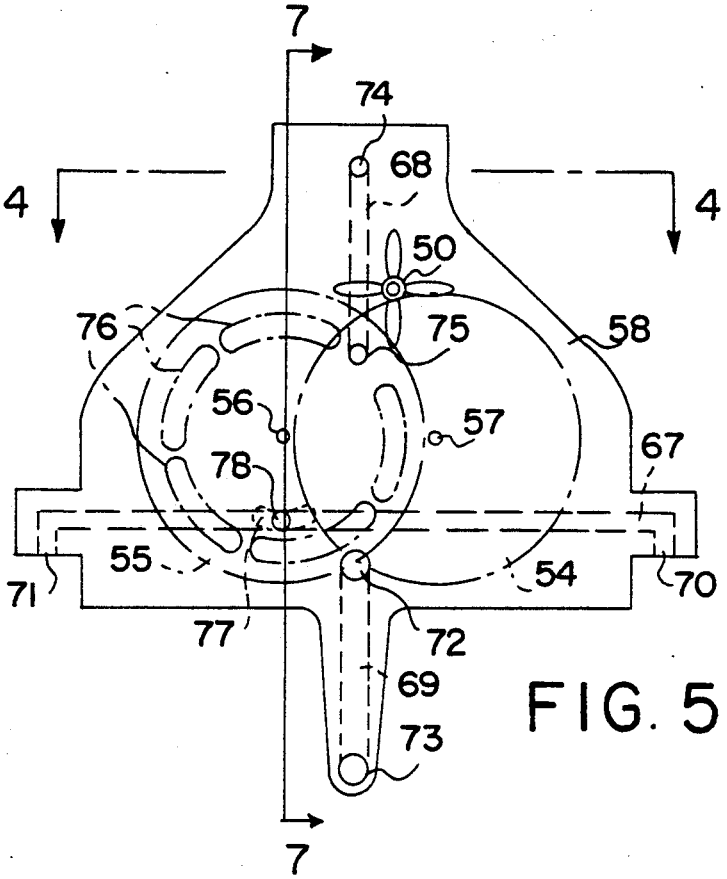
FIG. 5 is a top view of the timing mechanism showing portions of the timing mechanism utilized in reversing the flow of water in the pool cleaner to reverse its direction of movement.

FIG. 5 is a top view of the mechanism utilized in controlling the flow of water and therefore the direction of the propulsion of pool cleaner 10. Base 58 is provided which includes the means for positioning and holding in position the gears and propeller with respect to each other and with respect to base 58, as well as including passageways designed to facilitate water flow to the proper locations at the desired times. For purposes of considering the operation of this mechanism, while the main view being considered is FIG. 5, viewing FIGS. 3, 4, 5 and 7 will be helpful to an understanding of the full operation of pool cleaner 10. When water flows through nipple 46 into cavity 42 as shown in FIG. 3 of the drawings, it acts on propeller 50, turning it. When propeller 50 begins to turn as a result of the water pressure, gear 59 of propeller 50 also turns, turning gear 52. As gear 52 turns, gear 60, which is substantially rigidly attached thereto, also turns, correspondingly turning gear 53. As gear 53 is turned, gear 61, which is substantially rigidly attached thereto, also turns, turning gear 54. As gear 54 is turned, gear 62, which is substantially rigidly attached thereto, also turns, turning gear 55. As a result of the sizing of the gears shown, considerable reduction occurs so that, even though propeller 50 may be turning very rapidly as a result of the water pressure propelling it, gear 55 turns very slowly. As shown in FIG. 5, gear 55 includes several slots 76, as shown in dashed lines, along a first diameter, and a second slot 77, also shown by dashed lines. These slots 76 and 77 are provided to facilitate control of the flow of water to the propulsion mechanism utilized in pool cleaner 10. Gear 55 is mounted substantially flush with respect to the surface of base 58. Base 58 includes a hole 72 into which water from cavity 42 flows regardless of the position of gears 52, 53, 54 or 55, and a passageway 69 communicating therewith which routes the water to opening 73, which communicates with fitting 63 as shown in FIG. 3 of the drawings. The control which gear 55 exerts over water flow has to do with the question whether water flows through passage 68 or through passage 67. Because gear 55 is mounted substantially flush with respect to the surface of base 58, the flow of water into hole 75 and/or hole 78 in base 58 is substantially cut off if such holes are not aligned with either slots 76 or slot 77. As will be seen in the view shown in FIG. 5, the position of slot 77 on gear 55 is such that it communicates with hole 78 during the time when hole 75 is covered by a solid portion of gear 55 and not open to a slot. The length of slot 77 is such that it communicates substantially with hole 78 throughout the period during which hole 75 is isolated from water. As a result of multiple slots 76 in gear 55, water flows into hole 75 and through passage 68 to opening 74 during most of the operation of pool cleaner 10. Opening 74 communicates with hole 65 of fitting 48, as shown in FIG. 3. Therefore, during most of the operating time of pool cleaner 10, water exits hole 65, propelling pool cleaner 10 forward for normal operation. When gear 55 reaches the position shown in FIG. 5, the water flow to hole 75 and, therefore, the forward propulsion, is temporarily cut off. During this time period, water flows through slot 77 into hole 78 and through passage 67 to openings 70 and 71, thereby directing water flow in a direction opposite to the direction of flow during the major part of the operation of pool cleaner 10. Because of the small size of slot 77, water is directed to passage 67 only over a very short time. The purpose of the water directed through passage 67 to openings 70 and 71 is to reverse the direction of pool cleaner 10 to extricate it from tight areas in which it might otherwise be stuck, and to do this automatically, so that it does not require the amount of supervision normally involved in utilizing pool sweeps.

Figure 6:
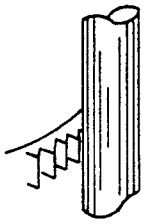
FIG. 6 is an expanded view showing the gearing arrangement utilized in the gearing system designed to reverse the direction of the pool cleaner.

FIG. 6 of the drawings shows the gearing mechanism more clearly. The teeth 66 of gear 52 are typical of gears 53, 54 and 55, and the teeth of gear 59 are typical of gears 60, 61 and 62.

Figure 7:
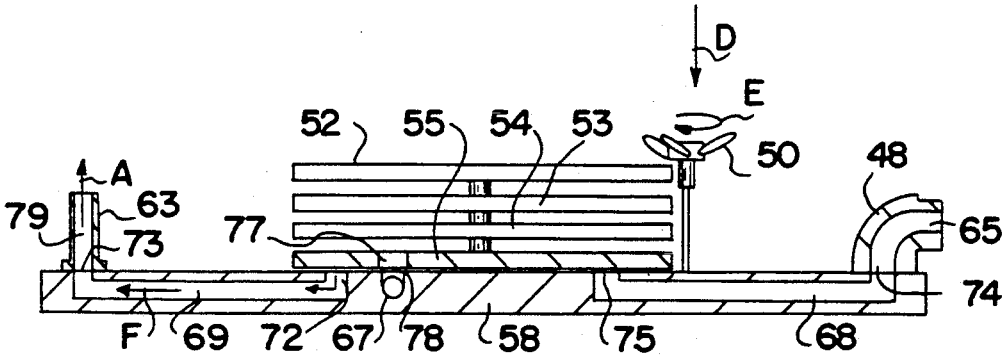
FIG. 7 is a cross-sectional view of the mechanism utilized in reversing the direction of the pool cleaner taken along lines 7—7 of FIG. 5.

FIG. 7 is a cross-sectional view of the mechanism utilized in directing water flow taken along lines 7—7 of FIG. 5. FIG. 7 shows the position of gears 52, 53, 54 and 55 during flow of water through passage 67. As indicated in FIG. 7, water entering cavity 42 of FIG. 3 enters along the path shown by arrow D, turning propeller 50 as shown by arrow E and turning gears 52, 53, 54 and 55. As shown in FIGS. 5 and 7, water flows continuously through hole 72 and passage 69 as shown by arrow F, and up through opening 73 and through hole 79 of fitting 63 along arrow A. This flow continues regardless of the position of the gears in the unit. When slot 77 is aligned with opening 78 in base 58, water flows therethrough and into and through passage 67 to openings 70 and 71, shown in FIG. 5. When water is flowing through passage 67, gear 55 acts to restrict flow into hole 75. Once slots 76 again align with hole 75, water flows into hole 75, through passage 68, through hole 74 into hole 65 of fitting 48, and out through hole 65 of fitting 48 to propel pool cleaner 10 in a forward motion. During this time period, gear 55 acts to prevent water from flowing into hole 78 and passage 67.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A pool cleaner for removing debris from pools and the like comprising:

a body having a top end, a bottom end, a front end and a back end, a cavity therein, an opening near said bottom end and an opening near said top end;

means for supplying pressurized water to said cavity of said body;

first routing means for routing and directing a first portion of said pressurized water toward said opening in said top end of said body so that pool water and debris are drawn into said cavity through said opening near said bottom end of said body and through said opening near said top end of said body along with said first portion of said pressurized water;

filter means for capturing said debris exiting said pool cleaner through said opening near said top end of said body;

a first water outlet positioned near said back end of said body;

a second routing means for routing a second portion of said pressurized water to said first water outlet so that, as water exits said first water outlet, the force exerted thereby moves said body forward;

a second water outlet positioned and oriented to direct pressurized water in a direction substantially opposite that of pressurized water directed through said first water outlet;

third routing means for routing a third portion of said pressurized water to said second water outlet so that, as water exits said second water outlet, force exerted thereby moves said body backward;

control means for controlling flow of water to said first and second water outlets, and wheels rotatably attached to said body to facilitate movement of said body across a surface.

2. The invention of claim 1, wherein said control means includes a mechanism for alternately directing said third portion of said pressurized water to said second water outlet for a first period of time and said second portion of said pressurized water to said first water outlet for a second period of time.

3. The invention of claim 2, wherein said mechanism consists substantially of a propeller activated by pressurized water flowing into said cavity, a series of reduction gears, including a control gear, operationally attached to said propeller and to each other so that, when said propeller turns, said control gear turns at a considerably slower rate, said control gear having a series of slots which communicate with said second routing means over most of said control gear's rotation, and a short slot which communicates with said third routing means over a short part of said control gear's rotation and which is positioned so that said short slot routes water to said third routing means when flow of water is restricted to said second routing means.

4. The invention of claim 1, including a diverter wheel rotatably mounted on a substantially vertical axis near said front end of said body to divert said pool cleaner right or left when said pool cleaner encounters a pool wall.

5. The invention of claim 4, wherein said diverter wheel has holes therein so that resistance of said diverter wheel to water flow is reduced, increasing stability of said pool cleaner.

* * * * *